US005467901A

United States Patent [19]

Foster et al.

[11] Patent Number: 5,467,901

[45] Date of Patent: Nov. 21, 1995

[54] TRIGGER SPRAYER OPERABLE IN UPRIGHT, DOWNTURNED & INVERTED POSITIONS

[75] Inventors: Donald D. Foster, St. Charles; Philip L. Nelson, Ellisville, both of Mo.

[73] Assignee: Contico International, Inc., St. Louis, Mo.

[21] Appl. No.: 327,181

[22] Filed: Oct. 21, 1994

Related U.S. Application Data

[63] Continuation-in-part of Ser. No. 242,281, May 13, 1994.

[51] Int. Cl.[6] ..... B67D 5/42

[52] U.S. Cl. ..... 222/376; 222/383.1

[58] Field of Search ..... 222/376, 385, 222/481, 481.5, 482, 321.1–321.9, 383.1–383.3

[56] References Cited

U.S. PATENT DOCUMENTS

| | | | |
|---|---|---|---|
| 1,484,920 | 2/1924 | Wolfe . | |
| 1,735,784 | 11/1929 | Olson . | |
| 2,812,117 | 11/1957 | Butkus et al. . | |
| 2,851,201 | 9/1958 | Poitras et al. . | |
| 3,315,693 | 4/1967 | Braun . | |
| 3,379,136 | 4/1968 | Corsette . | |
| 3,545,488 | 12/1970 | Venus, Jr. | 222/376 X |
| 4,174,790 | 11/1979 | Nozawa et al. . | |
| 4,274,560 | 6/1981 | Cater . | |
| 4,277,001 | 7/1981 | Nozawa . | |
| 4,284,211 | 8/1981 | Meshberg . | |
| 4,726,386 | 2/1988 | Schultz . | |
| 4,735,347 | 4/1988 | Schultz et al. . | |
| 4,775,079 | 10/1988 | Grothoff . | |
| 4,895,279 | 1/1990 | Schultz . | |
| 4,942,985 | 7/1990 | Schultz . | |
| 4,991,746 | 2/1991 | Schultz . | |
| 5,119,974 | 6/1992 | Mann . | |
| 5,125,543 | 6/1992 | Rohrabacher et al. . | |
| 5,183,186 | 2/1993 | Delaney, Jr. . | |
| 5,192,007 | 3/1993 | Blomquist . | |
| 5,195,664 | 3/1993 | Rhea . | |
| 5,222,636 | 6/1993 | Meuresch . | |
| 5,277,559 | 1/1994 | Schultz . | |
| 5,341,967 | 8/1994 | Silvenis . | |

FOREIGN PATENT DOCUMENTS

| | | |
|---|---|---|
| 2632662 | 1/1977 | Germany . |
| 3929064 | 1/1991 | Germany . |
| 287342 | 3/1953 | Switzerland . |

*Primary Examiner*—Andres Kashnikow
*Assistant Examiner*—Kenneth Bomerg
*Attorney, Agent, or Firm*—Rogers, Howell & Haferkamp

[57] ABSTRACT

A manually operable trigger sprayer is capable of dispensing a liquid from a container with the trigger sprayer alternately held in an upright orientation, in a downturned orientation and in an inverted orientation. In operation of the trigger sprayer in all three orientation positions, the liquid in the container is prevented from leaking through the vent passage of the trigger sprayer regardless of the level of liquid within the container.

20 Claims, 2 Drawing Sheets

TRIGGER SPRAYER OPERABLE IN UPRIGHT, DOWNTURNED & INVERTED POSITIONS

This application is a continuation-in-part of application Ser. No. 08/242,281, filed May 13, 1994.

BACKGROUND OF THE INVENTION (1) Field of the Invention

The present invention is directed to a manually operable spray dispenser for dispensing liquid substances from a container. In particular, the present invention is a trigger spray dispenser or trigger sprayer capable of dispensing liquid in an upright, a downturned, or an inverted orientation. Further, the trigger sprayer is constructed so as to prevent liquid from leaking through the trigger sprayer vent passage when in any of the three orientations regardless of the level of the liquid in the container.

(2) Description of the Related Art

Generally, trigger sprayers are only operable in an upright orientation with the dispenser housing positioned above the container. Trigger sprayers typically have a vent passage to prevent a vacuum from developing in the container as liquid is withdrawn. If the trigger sprayer is operated in a downturned orientation with the dispenser housing positioned beside the container to dispense liquid directly downward, liquid will often leak through the vent passage of the trigger sprayer.

The trigger sprayers usually employ a dip tube extending from the trigger sprayer housing to a distal end of the tube at the bottom of the container. The dip tube draws liquid from the container no matter what the liquid level so long as the sprayer is in the upright orientation. Depending upon the amount of liquid in the container, the distal end of the dip tube may be raised above the level of the liquid when the trigger sprayer is positioned in any orientation other than upright. With the dip tube raised out of the liquid, the trigger sprayer will dispense the liquid remaining in the dip tube as the trigger is actuated, but once the liquid in the dip tube has been dispensed further trigger actuation will result in only air being dispensed from the container. Thus, when a typical trigger sprayer is operated in the inverted orientation with the sprayer housing positioned below the container, liquid will leak through the sprayer vent passage and the end of the dip tube will project above the level of liquid in the container resulting in only air being dispensed once the liquid in the dip tube has been dispensed.

Several trigger sprayers have been designed for operation in both upright and inverted orientations. Their designs prevent the liquid in the container from leaking through the triger sprayer vent passage when held in an inverted orientation. These trigger sprayers also continue to supply liquid to the trigger sprayer pump chamber when they are held in an inverted orientation even with the end of the dip tube projecting above the level of the liquid in the container. However, these trigger sprayers are only designed to operate with the sprayers positioned in the upright or inverted orientations. When these trigger sprayers are operated in a downturned orientation with the nozzle of the trigger sprayer pointed directly downward and the container positioned beside the sprayer housing, the liquid in the container will often leak through the vent passage of the trigger sprayer. Furthermore, many of the trigger sprayers designed to operate in an inverted orientation will draw air instead of liquid from the container if operated in a downturned orientation.

SUMMARY OF THE INVENTION

The trigger sprayer of the present invention overcomes the shortcomings of prior art trigger sprayers designed for operation in upright and inverted orientations. The trigger sprayer of the present invention provides a design that permits the trigger sprayer to dispense liquid from a container in upright, downturned and inverted orientations of the sprayer while preventing liquid from leaking through the trigger sprayer vent passage and also preventing the trigger sprayer pump from drawing only air regardless of the level of liquid within the container.

The trigger sprayer of the present invention has a dispenser head which has many of the features typically found in trigger sprayers. These features include a fluid discharge passage containing a fluid spinner, a pump cylinder, a vent cylinder, a pump piston positioned for reciprocating movement within the pump cylinder and a vent poppet connected to the pump piston and positioned for reciprocating movement within the vent cylinder to alternately open and close the vent passage. A pump chamber is formed by the pump cylinder and piston. This chamber draws liquid from the container and expels it through the nozzle orifice upon reciprocation of the pump piston in the pump cylinder. A trigger is pivotally attached to the dispenser head and is operatively connected to the pump piston and vent poppet to impart reciprocating movement to the piston and poppet. Fluid passages extend through the dispensing head communicating the interior of the pump chamber with the fluid discharge passage and communicating the pump chamber with a dip tube that extends from the dispenser head into the container.

The fluid passages include a main or primary passage and an auxiliary or secondary passage. The dip tube depending from the dispenser head is part of the primary passage. A check valve is also positioned in the primary passage as is typical of many trigger sprayers. The check valve permits liquid to flow through the primary passage from the container to the pump chamber but prevents backflow through the primary passage from the pump chamber to the liquid container. The auxiliary or secondary passage communicates with the primary passage and provides fluid communication between the primary passage and both the vent cylinder of the sprayer and the interior of the liquid container adjacent the container's connection to the sprayer. An orientation-sensitive valve is positioned within the secondary passage to block both the vent chamber and the container interior from the primary passage when the trigger sprayer is in the upright orientation and to open communication between the container interior and the primary passage while blocking communication with the vent cylinder when the sprayer is in the downturned or inverted orientation.

Thus, the liquid within the container is prevented from leaking through the vent passage during operation in either the inverted or the downturned orientations. When the trigger sprayer is in the upright orientation, the valve opens, permitting the container to vent.

In the preferred embodiment, the orientation-sensitive valve is a ball valve and the secondary passage is provided with first and second valve seats. The first valve seat is positioned at the bottom of the secondary passage with the sprayer in the upright orientation so that the ball seats against it when the trigger sprayer is in the upright orientation, thereby blocking communication between the secondary passage and the primary passage while permitting communication between the vent cylinder and the container interior to allow venting of the container. The second valve seat is positioned at an opposite end of the secondary passage from the first valve seat and faces downward so that the ball seats against it when the trigger sprayer is in the downturned or inverted orientations to thereby block communication between the secondary passage and the vent cylinder while permitting communication between the primary passage and the container interior. When the trigger dispenser is in the inverted or downturned orientations, the ball valve unseats from the first valve seat and seats against the second valve seat thereby blocking communication between the secondary passage and the vent cylinder and opening communication between the primary passage and the container interior through the secondary passage. This enables the liquid in the container to pass through the secondary passage and into the primary passage thereby providing the liquid to the pump chamber when the dispenser head is inverted or downturned and the end of the dip tube extends above the level of liquid in the container.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

The novel construction of the trigger sprayer of the present invention enables the trigger sprayer to be operated when positioned in either an upright orientation, a downturned orientation or an inverted orientation. What is meant by the upright orientation is that the trigger sprayer is positioned in an orientation where the container attached to the sprayer housing is suspended beneath the housing and the spray pattern discharged from the sprayer is directed horizontally forward from the sprayer. What is meant by the downturned orientation is that the nozzle of the trigger sprayer is pointed downward so that the spray discharged from the sprayer is directed vertically downward and the container is positioned beside the sprayer housing. What is meant by the inverted orientation of the trigger sprayer is that the trigger sprayer is positioned with the container above the trigger sprayer housing and the spray pattern discharged from the nozzle is directed horizontally forward from the sprayer.

Figure 1:
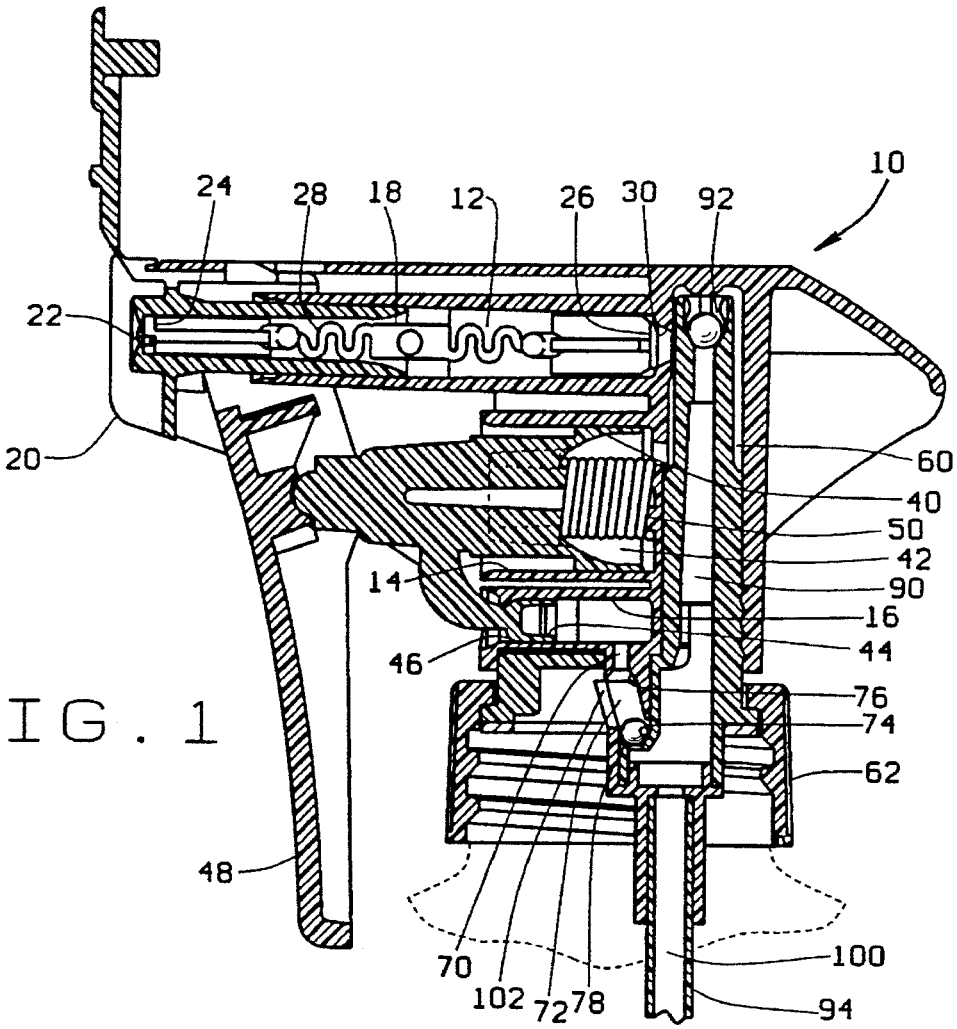
FIG. 1 is a view in section of the trigger sprayer of the present invention shown in the upright orientation.

Referring to FIG. 1, the trigger sprayer of the present invention is comprised of a housing 10 having a fluid discharge passage 12, a pump cylinder 14 and a vent cylinder 16 formed therein. A fluid spinner 18 is positioned in the fluid discharge passage 12 and a spray nozzle 20 having an orifice 22 is inserted at the end of the discharge passage. As is typical of may trigger sprayers, the fluid spinner 18 has a swirler head 24 which induces a vortex in the fluid as it is pumped out the spray nozzle orifice 22 to improve the spray characteristics of the trigger dispenser. The end of the spinner 18 opposite the swirler head 24 is formed into a primary valve member 26. A spring member 28 between the swirler head 24 and primary valve member 26 biases the head and valve member apart to seat the valve member 26 in a primary valve seat 30 formed at the rearward end of the fluid discharge passage 12. Thus, the primary valve member 26 and seat 30 act as a check valve to prevent fluid backflow through the discharge passage 12.

A pump piston 40 reciprocates within the pump cylinder 14 and forms a pump chamber 42 therebetween which expands and contracts in response to reciprocation of the piston 40 within the cylinder 14 to draw liquid from a container (shown in dashed lines in FIG. 1) and expel it through the nozzle orifice 22. A vent poppet 44 connected to the pump piston 40 reciprocates within the vent cylinder 16 and alternately seats and. unseats with a poppet seat 46 at the forward end of the vent cylinder to close and open a passage through the vent cylinder. A trigger 48 is connected to the housing 10 by a hinge (not shown) and pivots against the pump piston 40 and vent poppet 44 to provide leverage and aid in moving the piston and poppet in their respective cylinders upon manual manipulation of the trigger 48. A helical spring 50 within the pump cylinder 14 biases the pump piston 40 toward an extended position. Thus, the pump chamber volume is increased when the trigger 48 is released.

An annular vertical passage 60 extends upward through the housing 10, communicating the fluid discharge passage 12 with the pump cylinder 14. An internally threaded cap 62 is rotatively connected to the bottom of the housing 10 for attaching the housing to the liquid-filled container. The features of the trigger sprayer of the invention described thus far are typical of many trigger sprayers.

The housing 10 is also formed with a vent passage 70 extending between the interior of the vent cylinder 16 and the container interior attached to the housing. The vent passage 70 leads into a secondary passage 72 that includes a valve chamber having a first valve seat 74 and a second valve seat 76. The secondary passage 72 contains a valve member 78 or a ball valve sized to seat against and alternately block both the first and second valve seats 74, 76. The secondary passage 72 is obliquely angled such that the first valve seat 74 is below and behind the second valve seat 76 when the trigger dispenser is in the upright orientation. Thus, the ball valve 78 will seat on the first valve seat 74 when the trigger dispenser is in the upright orientation and will seat on the second valve seat 76 when the trigger dispenser is in the downturned and inverted orientations.

Figure 2:
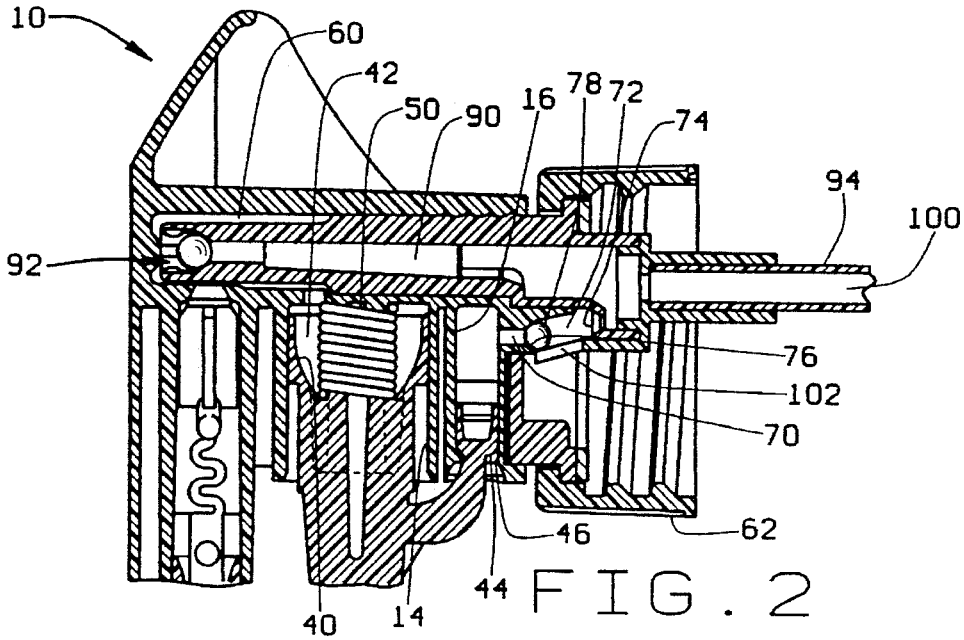
FIG. 2 is a partial view in section of the trigger sprayer shown in the downturned orientation.
Figure 3:
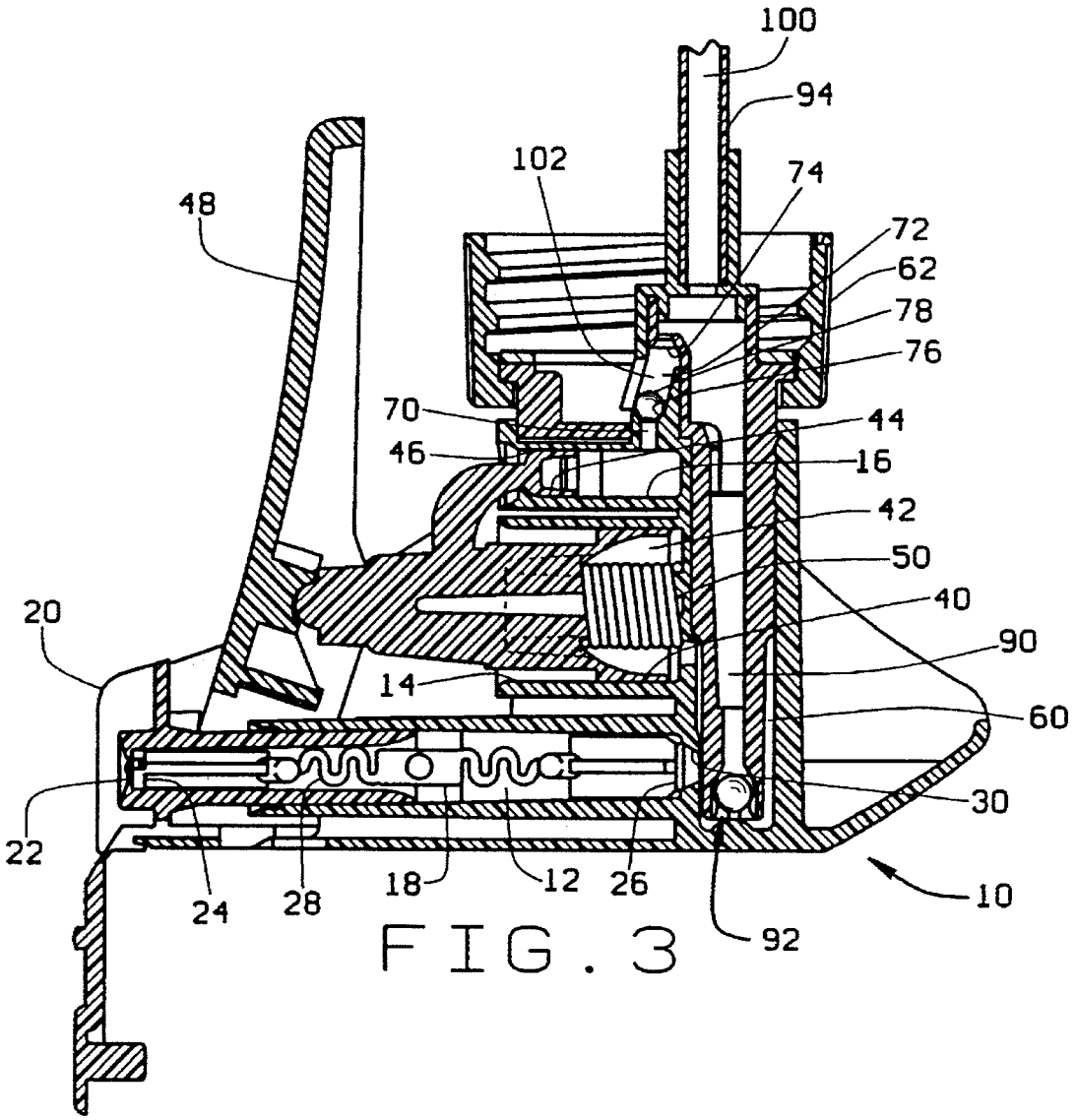
FIG. 3 is a view in section of the trigger sprayer shown in the inverted orientation.
Figure 4:
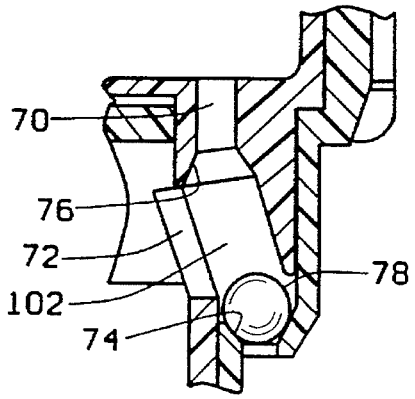
FIG. 4 is a partial view showing in detail the secondary passage.

An inlet passage 90 extends downward through the housing 10 from a check valve 92 at the top of the passage to a dip tube 94 at the bottom of the passage. The check valve 92 operates in the same manner as check valves of typical trigger sprayers and only permits fluid flow through the passage 90 in response to expansion of the pump chamber 42. The check valve 92 prevents fluid flow into the inlet passage 90 from the pump chamber 42 when the pump piston 40 is moved through its compression stroke in the pump cylinder 14. This causes the liquid forced out of the pump chamber 42 to unseat the primary valve member 26 from the valve seat 30 which permits fluid to pass through the fluid discharge passage 12 and dispense as a spray from the orifice 22. This operation of the check valve 92 occurs whether the housing 10 of the trigger sprayer is positioned in the upright orientation as shown in FIG. 1, the downturned orientation as shown in FIG. 2, or the inverted orientation as shown in FIG. 3.

The inlet passage 90 extends from the check valve 92 to the dip tube 94. Together, the inlet passage 90 and the dip tube 94 make up a primary passage 100 of the preferred embodiment. Although not shown in the drawing figures, the configuration of the dip tube 94 is such that it curves to the forward, bottom corner of the container to which the trigger sprayer housing is attached. This enables the distal end of the dip tube to extend into the liquid of the container when the trigger sprayer is positioned in the upright or downturned orientation even when the amount of liquid remaining in the container is very small and the liquid level is low.

The secondary passage 72 extends between the inlet passage 90 and a slot 102 opening to the container interior as well as the vent passage 70. The slot 102 is dimensioned sufficiently small to permit the ball valve 78 to roll over the slot without passing through or obstructing the slot. As seen in the drawing figures, the secondary passage 72 extends between the inlet passage 90 and the container interior at a position proximate the top of the container. The ball valve 78 seats over the first valve seat 74 and blocks communication between the inlet passage 90 and the vent cylinder 16 and container interior through the secondary passage when the housing 10 of the trigger sprayer is in the upright orientation. When housing 10 of the trigger sprayer is moved to the downturned or inverted orientations, the ball valve 78 rolls through the secondary passage 72 from the first valve seat 74 to the second valve seat 76 and seats over the second valve seat 76 blocking communication between the vent passage 70 and the secondary passage 72 while opening communication between the container interior and the inlet passage 90 through the slot 102 and the secondary passage 72.

In operation of the trigger sprayer housing 10 in the upright orientation as shown in FIG. 1, the ball valve 78 is seated against the first valve seat 74, thereby blocking communication between the secondary passage 72 and the inlet passage 90 and unblocking communication between the vent passage 70 and the container interior through the slot opening 102. This enables the interior of the container to vent through the vent passage 70 on the compression stroke of the pump piston 40. On the return stroke of the pump piston, the suction created in the pump chamber 42 draws liquid up through the dip tube 94 and the inlet passage 90, unseats the check valve 92, and draws the liquid into the pump chamber 42. Because the secondary passage 102 is blocked, air is not drawn from the top of the container to the inlet passage 90 and into the pump chamber. On the subsequent compression stroke of the pump piston 40, the fluid contained in the pump chamber 42 is forced out of the chamber, unseating the primary valve member 26 from the valve seat 30. Thus, the fluid passes through the discharge passage 12 and is dispensed as a spray from the spray nozzle orifice 22.

In operation of the trigger sprayer housing 10 positioned in its downturned orientation shown in FIG. 2, the ball valve 78 rolls over the slot 102 and seats over the second valve seat 76 of the secondary passage 72 blocking fluid communication of the vent passage 70 with the container interior and the inlet passage 90 and preventing the liquid within the downturned container from leaking through the slot opening 102 and the vent passage and out the vent cylinder 16 when the poppet 44 reciprocates within the vent cylinder 16. The movement of the ball valve 78 through the secondary passage from the first seat 74 to the second seat 76 also opens communication between the inlet passage 90 and the container interior through the slot opening 102 and the secondary passage 72. The compression stroke of the pump piston 40 operates in the same manner as described above with regard to the trigger sprayer being positioned in the upright orientation. The fluid pressure in the pump chamber 42 causes the inlet passage check valve 92 to seat, directing the fluid through the discharge passage 12 and out the spray nozzle orifice 22. On the expansion stroke of the pump piston 40, the vacuum created in the pump chamber 42 unseats the inlet passage check valve 92 and draws liquid through the dip tube 94 and inlet passage 90. As explained earlier, the dip tube 94 of the preferred embodiment of the primary passage 100 curves as it extends to its distal end, positioning its distal end at the forward, bottom corner of the container. Thus, the return stroke of the pump piston 40 draws the liquid remaining in the container through the dip tube 94 and the inlet passage 90 to the pump chamber 42. Because the secondary passage 72 is not blocked by the ball valve 78, liquid will also be drawn through the slot opening 102, the secondary passage, and the inlet passage 90 to the pump chamber on the return stroke provided that the level of the liquid within the container is above the secondary passage, thereby preventing air in the container from being drawn through the secondary passage.

In operation of the trigger sprayer housing 10 with the trigger sprayer positioned in the inverted orientation shown in FIG. 3, the ball valve 78 seats over the second valve seat 76 of the secondary passage just as in the downturned orientation, thereby blocking the vent passage and preventing the liquid in the container from leaking through the passage and out the vent cylinder. Thus, liquid in the inverted container may pass through the slot opening 102 and the secondary passage 72 to the inlet passage 90 thereby supplying the liquid to the pump chamber 42 even though the distal end of the dip tube 94 is positioned above the level of liquid in the container. On the compression stroke of the pump piston 40, the inlet passage check valve 92 seats in the same manner as when the trigger sprayer is operated in the upright orientation, preventing the passage of liquid from the pump chamber 42 and back through the inlet passage 90. The liquid forced out of the pump chamber 42 unseats the primary valve member 26 from the primary valve seat 30 and passes through the discharge passage 12 and dispenses from the trigger sprayer spray nozzle orifice 22. On the return stroke of the pump piston 40, the suction created unseats the inlet passage check valve 92, drawing liquid through the inlet passage 90 and the secondary passage 72. The pressure head of the liquid contained in the container in its inverted orientation maintains the level of liquid in the inverted dip tube 94 at the same level as the liquid in the container thereby preventing the pump piston 40 from drawing air through the dip tube.

While the present invention has been described by reference to a specific embodiment, it should be understood that modifications and variations of the invention may be constructed without departing from the scope of the invention defined in the following claims. For example, the ball valve members may be replaced by flapper valve members that seat over the first and second valve seats to block communication through the connecting passages.

What is claimed is:

1. A spray dispenser for dispensing a liquid from a container in an upright orientation, an inverted orientation and a downturned orientation of the dispenser, the spray dispenser comprising:

a housing having an orifice through which the liquid is dispensed and having means for attaching the housing to the liquid container;

means in the housing for pumping liquid from the container and dispensing the liquid through the orifice when the spray dispenser is in both the upright orientation and the downturned orientation;

a vent passage in the housing extending between an interior of the container and an exterior environment of the container and housing for venting the container to the exterior environment; and means in the housing for preventing the liquid in the container from flowing through the vent passage when the spray dispenser is in the downturned orientation and the means for pumping and dispensing the liquid is dispensing the liquid through the orifice.

2. The spray dispenser of claim 1 further comprising:

said means for pumping the liquid from the container and through the orifice also pumps the liquid when the spray dispenser is in the inverted orientation.

3. The spray dispenser of claim 2 further comprising:

said means for preventing the liquid from flowing through the vent passage also prevents the liquid from flowing through the vent passage when the spray dispenser is in the inverted orientation and the means for pumping and dispensing the liquid is dispensing the liquid through the orifice.

4. The spray dispenser of claim 3 wherein:

said means for preventing the liquid from flowing through the vent passage when the spray dispenser is in the downturned orientation and the means for pumping and dispensing the liquid is dispensing the liquid through the orifice, and the means for preventing the liquid from flowing through the vent passage when the spray dispenser is in the inverted orientation and the means for pumping and dispensing the liquid is dispensing the liquid through the orifice is a single orientation-sensitive valve.

5. The spray dispenser of claim 4 wherein:

the single orientation-sensitive valve is a ball valve having at least two separate valve seats spaced within the valve.

6. The spray dispenser of claim 1 further comprising:

an inlet passage in the housing for fluid communication between the container interior and the means for pumping the liquid from the container and through the orifice when the spray dispenser is in both the upright orientation and the downturned orientation; and an elongated dip tube having opposite proximal and distal ends, the dip tube being connected to the inlet passage at the proximal end and extending into the container interior.

7. A spray dispenser assembly for dispensing a liquid, the dispenser being operable in an upright orientation, a downturned orientation and an inverted orientation, the spray dispenser assembly comprising:

a housing having an outlet orifice through which the liquid is dispensed;

a container attached to the housing for holding the liquid in an interior of the container;

a pump chamber within the housing for pumping the liquid from the container and through the outlet orifice;

a primary passage within the housing extending between the pump chamber and the container for delivering the liquid from the container to the pump chamber when the dispenser is positioned in the upright orientation;

a secondary passage extending between the container interior at a top end of the container and the primary passage for delivering the liquid from the container interior to the pump chamber when the dispenser is positioned in the inverted orientation;

a vent passage in the housing extending between the container interior and an exterior environment of the container for preventing a vacuum from developing within the container as the liquid is removed therefrom; and a valve positioned in the secondary passage adjacent the top end of the container, the valve being configured to inhibit fluid flow through the secondary passage from the container interior to the primary passage when the spray dispenser is in the upright orientation, the valve being configured to permit fluid flow through the secondary passage from the container interior to the primary passage and inhibit fluid flow through the vent passage when the spray dispenser is in the inverted orientation, and the valve being configured to inhibit fluid flow through the vent passage when the spray dispenser is in the downturned orientation.

8. The spray dispenser assembly of claim 7 wherein the valve comprises:

a valve chamber having an interior with spaced first and second valve seats therein, the valve chamber having an opening communicating the valve chamber with the container interior adjacent the top end of the container, the first valve seat providing fluid communication between the valve chamber and the primary passage, the second valve seat providing fluid communication between the valve chamber and the vent passage, the first valve seat being lower than the second valve seat when the spray dispenser is in the upright orientation, the second valve seat being lower than the first valve seat when the spray dispenser is in both the downturned orientation and the inverted orientation; and a moveable valve member positioned within the interior of the valve chamber, the valve member being configured to seat against the first valve seat to prevent fluid flow through the secondary passage when the spray dispenser is in the upright orientation, and the valve member being configured to seat against the second valve seat to prevent fluid flow through the vent passage when the spray dispenser is in both the downturned orientation and the inverted orientation.

9. The spray dispenser of claim 8 wherein:

the valve chamber interior is substantially cylindrically shaped and obliquely oriented between a first and second end, the first valve seat being positioned adjacent the first valve chamber end, the second valve seat being positioned adjacent the second valve chamber end, both the first valve seat and the second valve seat facing the valve chamber interior, the first valve seat being configured to accept the valve member and interrupt fluid communication through the valve chamber between the secondary passage and the primary passage when the dispenser is positioned in the upright orientation, the second valve seat being configured to accept the valve member and interrupt fluid communication through the valve chamber between the container and the vent passage when the dispenser is positioned in both the downturned orientation and the inverted orientation.

10. The spray dispenser of claim 8 wherein:

the valve member is a ball.

11. A trigger sprayer for dispensing liquid from a container in an upright orientation, a downturned orientation, and an inverted orientation of the trigger sprayer, the trigger sprayer comprising:

a sprayer housing;

a fluid discharge passage in the housing, the fluid discharge passage having a length with a center axis and having a nozzle orifice at one end of the discharge passage length and a fluid inlet at an axially opposite end of the discharge passage length;

a pump chamber in the housing;

a vent chamber in the housing;

a primary passage in the housing extending between and providing fluid communication between the pump chamber and fluid discharge passage and the container of liquid when the trigger sprayer is attached to the container of liquid; and, a secondary passage in the housing extending between the vent chamber and the primary passage, the secondary passage having the center axis, and the center axis of the secondary passage being oriented at an acute angle relative to the center axis of the fluid discharge passage.

12. The trigger sprayer of claim 11, wherein:

the primary passage has an inlet passage section in the housing, the inlet passage section has a center axis, and the center axis of the inlet passage section is oriented at an acute angle relative to the center axis of the secondary passage.

13. The trigger sprayer of claim 11, wherein:

the secondary passage has an orientation in the sprayer housing where, when the trigger sprayer is in the upright orientation, the secondary passage slopes downwardly from the vent chamber to the primary passage, and when the trigger sprayer is in the downturned and the inverted orientations, the secondary passage slopes downwardly from the primary passage toward the vent chamber.

14. The trigger sprayer of claim 11, wherein:

the secondary passage has axially opposite ends with first and second valve seats at the opposite ends, the first valve seat is positioned adjacent the primary passage and the secondary passage communicates with the primary passage through the first valve seat, and the second valve seat is positioned adjacent the vent chamber and the secondary passage communicates with the vent chamber through the second valve seat; and a valve member is contained in the secondary passage between the first and second valve seats, the valve member moves in the secondary passage to close the first valve seat when the trigger sprayer is in the upright orientation and the valve member moves in the secondary passage to close the second valve seat when the trigger sprayer is in the downturned and inverted orientations.

15. The trigger sprayer of claim 14, wherein:

the valve member is a ball valve that rolls through the secondary passage and seats on the first valve seat to close the first valve seat when the trigger sprayer is moved to the upright orientation and that rolls through the secondary passage and seats on the second valve seat to close the second valve seat when the trigger sprayer is moved to the downturned and inverted orientations.

16. The trigger sprayer of claim 15, wherein:

an opening is provided in the secondary passage between the first and second valve seats, the opening provides fluid communication between the secondary passage and the container interior when the trigger sprayer is attached to the container.

17. A trigger sprayer for dispensing a liquid from a container in an upright orientation, a downturned orientation, and an inverted orientation of the trigger sprayer, the trigger sprayer comprising:

a sprayer housing, the sprayer housing having a cap for connecting the housing to a container of liquid;

a fluid discharge passage in the sprayer housing, the discharge passage having a nozzle orifice at one end and a fluid inlet at an opposite end of the discharge passage;

a pump chamber in the housing;

a vent chamber in the housing;

a primary passage in the housing extending between and providing fluid communication between the pump chamber and fluid discharge passage and the container of liquid when the trigger sprayer is attached to the container of liquid; and a secondary passage in the housing extending between the vent chamber and the primary passage, the secondary passage having a first valve seat therein adjacent the primary passage and a valve member which closes the first valve seat when the trigger sprayer is in the upright orientation, and the secondary passage having a second valve seat therein spaced from the first valve seat and adjacent the vent chamber and said valve member closes the second valve seat when the trigger sprayer is in the downturned and inverted orientations, and the first and second valve seats are positioned in the secondary passage where the first valve seat is positioned horizontally below the second valve seat when the trigger sprayer is in the upright orientation and the first valve seat is positioned horizontally above the second valve seat in both the downturned and inverted orientations of the trigger sprayer.

18. The trigger sprayer of claim 17, wherein:

the valve member is a single ball valve contained in the secondary passage for rolling movement within the secondary passage between the first and second valve seats.

19. The trigger sprayer of claim 17, wherein:

the secondary passage is upwardly inclined between the first and second valve seats when the trigger sprayer is in the upright orientation and the secondary passage is downwardly inclined between the first and second valve seats when the trigger sprayer is in both the downturned and the inverted orientations.

20. The trigger sprayer of claim 18, wherein:

the secondary passage has a slot opening therein that extends between the first and second valve seats and communicates the secondary passage with the interior of the liquid container when the trigger sprayer is attached to the liquid container, and the ball valve rolls along the slot between the first and second valve seats.

* * * * *